US008342820B2

(12) United States Patent
Kwon et al.

(10) Patent No.: US 8,342,820 B2
(45) Date of Patent: Jan. 1, 2013

(54) CRYOGENIC FLUID CIRCULATION PUMP

(75) Inventors: Woon sik Kwon, Changwon-si (KR); Heui joo Park, Gimhae-si (KR); Chi whan Lee, Dongnae-gu (KR); Yeong chun Kim, Changwon-si (KR)

(73) Assignee: Doosan Heavy Industries & Construction Co., Ltd., Changwon-si (KR)

( * ) Notice: Subject to any disclaimer, the term of this patent is extended or adjusted under 35 U.S.C. 154(b) by 736 days.

(21) Appl. No.: 12/402,146

(22) Filed: Mar. 11, 2009

(65) Prior Publication Data

US 2010/0061869 A1 Mar. 11, 2010

(30) Foreign Application Priority Data

Sep. 9, 2008 (KR) ..... 10-2008-0088792

(51) Int. Cl.
*F04B 17/00* (2006.01)

(52) U.S. Cl. ..... 417/420

(58) Field of Classification Search ..... 417/410.1, 417/423.1, 423.2, 420
See application file for complete search history.

(56) References Cited

U.S. PATENT DOCUMENTS

2007/0182513 A1* 8/2007 Burgess et al. ..... 335/18

OTHER PUBLICATIONS

U.S. Appl. No. 12/401,875, filed Mar. 11, 2009, Jung, et al.

* cited by examiner

*Primary Examiner* — Anh Mai
*Assistant Examiner* — Brenitra M Lee
(74) *Attorney, Agent, or Firm* — Oblon, Spivak, McClelland, Maier & Neustadt, L.L.P.

(57) ABSTRACT

Disclosed is a cryogenic fluid circulation pump that is capable of preventing heat from permeating into a cryogenic fluid by convection during the circulation of the cryogenic fluid by the pump and, at the same time, minimizing the transfer of heat to the cryogenic fluid circulating through a shaft rotating to rotate the pump. The cryogenic fluid circulation pump includes a magnet pump unit mounted in a vacuum chamber having an introduction channel and a discharge channel formed therein to prevent heat from permeating into the cryogenic fluid by convection for rotating by a magnetic force to circulate the cryogenic fluid, when a rotary force from a power source is transmitted to the magnet pump unit.

1 Claim, 2 Drawing Sheets

CRYOGENIC FLUID CIRCULATION PUMP

BACKGROUND OF THE INVENTION

1. Field of the Invention

The present invention relates to a pump for circulating a cryogenic fluid to feed the cryogenic fluid, and, more particularly, to a cryogenic fluid circulation pump that is capable of preventing heat from permeating into a cryogenic fluid by convection during the circulation of the cryogenic fluid by the pump and, at the same time, minimizing the transfer of heat to the cryogenic fluid circulating through a shaft rotating to rotate the pump.

2. Description of the Related Art

Generally, a cryogenic fluid is a fluid, such as general liquefied natural gas (LNG) or liquid oxygen, which is maintained at a sub-zero temperature of approximately −183° C. or less, although the temperature range is not definitely prescribed. It is required for a pump used to circulate and feed the cryogenic fluid to satisfy a requirement of minimizing the loss of the cryogenic fluid due to evaporation during the circulation of the cryogenic fluid considering a property of the cryogenic fluid.

However, a general fluid circulation pump is used under a condition of room temperature, and therefore, the general fluid circulation pump is not suitable for circulating a cryogenic fluid. For this reason, a pump capable of circulating and feeding the cryogenic fluid has been developed and used in recent years. A conventional cryogenic fluid circulating pump includes a housing constructed in a structure in which a cryogenic fluid is introduced through an impeller mounted inside the front thereof and is discharged through the side thereof. The impeller is connected to a drive shaft connected to a power source such that the impeller can rotate.

Also, a general mechanical seal or a labyrinth seal is mounted between the drive shaft connected to the impeller and the housing for preventing the leakage of the cryogenic fluid. The drive shaft, connecting the power source and the impeller, extends as long as possible to minimize the transfer of heat to the circulating cryogenic fluid.

In the conventional cryogenic fluid circulating pump with the above-stated construction, however, the housing in which the impeller is mounted is exposed to the atmosphere, with the result that the permeation of heat by convection is caused. Also, since the drive shaft, connecting the power source and the impeller, is very long to minimize the transfer of heat, the volume of the pump considerably increases.

Also, the mechanical seal or the labyrinth seal, mounted to minimize the leakage of the cryogenic fluid mounted between the housing and the drive shaft, is worn after the lapse of a specific period of use due to the continuous rotation of the drive shaft, with the result that, the leakage of the cryogenic fluid is caused.

For this reason, the conventional cryogenic fluid circulating pump is mainly used in an environment where heat loss and leakage are relatively ignored, i.e., a pump for LNG or a liquid nitrogen storage space.

SUMMARY OF THE INVENTION

Therefore, the present invention has been made in view of the above problems, and it is an object of the present invention to provide a cryogenic fluid circulation pump that is capable of preventing heat from permeating into a cryogenic fluid by convection during the circulation of the cryogenic fluid by the pump and, at the same time, minimizing the transfer of heat to the cryogenic fluid circulating through a shaft rotating to rotate the pump.

In accordance with the present invention, the above and other objects can be accomplished by the provision of a cryogenic fluid circulation pump for circulating a cryogenic fluid to feed the cryogenic fluid, the cryogenic fluid circulation pump comprising a magnet pump unit mounted in a vacuum chamber having an introduction channel and a discharge channel formed therein to prevent heat from permeating into the cryogenic fluid by convection for rotating by a magnetic force to circulate the cryogenic fluid, when a rotary force from a power source is transmitted to the magnet pump unit.

The magnet pump unit may circulate the cryogenic fluid by a rotary unit configured to rotate in a housing having a fluid introduction port and a fluid discharge port formed therein by a magnetic force from a drive unit connected to the power source such that the drive unit can rotate.

The drive unit may include a drive shaft directly connected to the power source and a drive member configured to surround an outer circumference of one side of the housing inside the vacuum chamber at one end of the drive shaft, the drive member having a plurality of magnets disposed at an inner circumference thereof in contact with the housing at predetermined intervals.

The rotary unit may include a rotary member including a magnet disposed at an outer circumference of one side thereof on a stationary shaft disposed in the housing such that the magnet can freely rotate and an impeller disposed at the side thereof opposite to the side where the magnet is disposed, at a position adjacent to the fluid introduction port and the fluid discharge port.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Now, an exemplary embodiment of the present invention will be described in detail with reference to the accompanying drawings.

Figure 1:
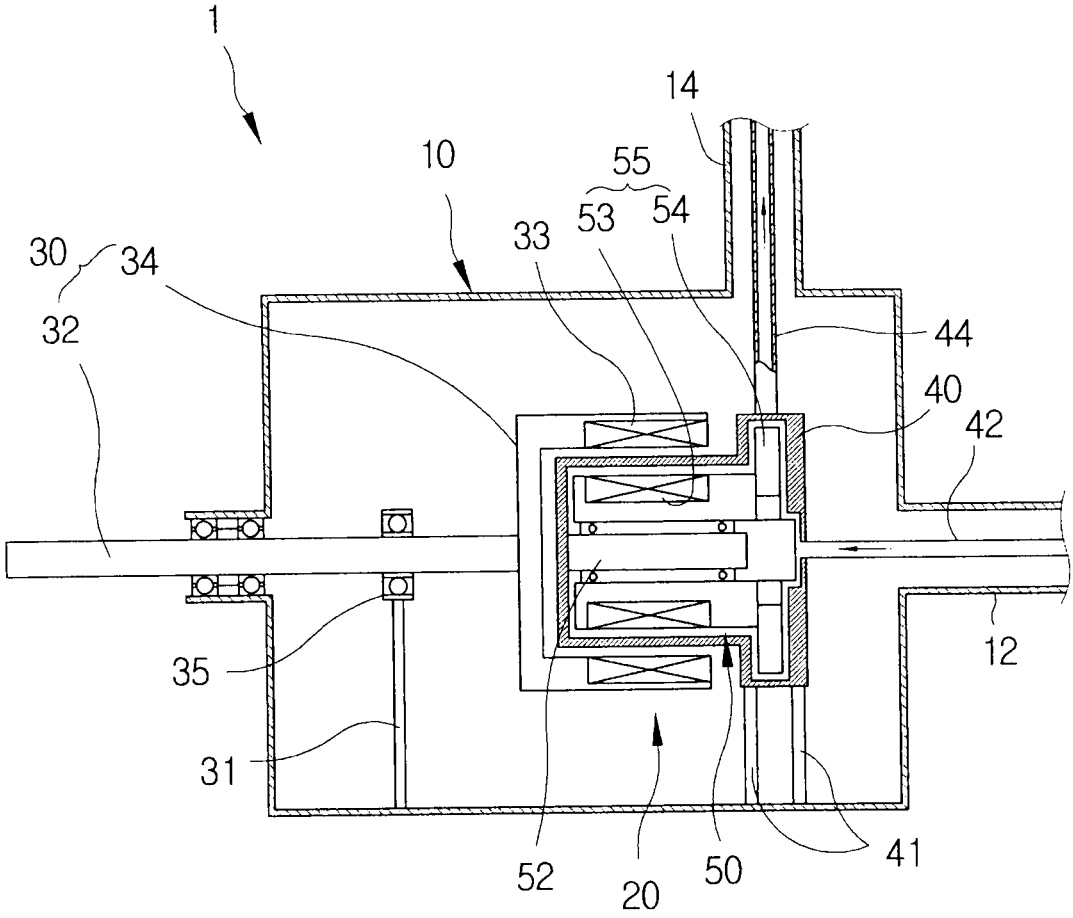
FIG. 1 is a sectional view schematically illustrating a principal part of a cryogenic fluid circulation pump according to an embodiment of the present invention.
Figure 2:
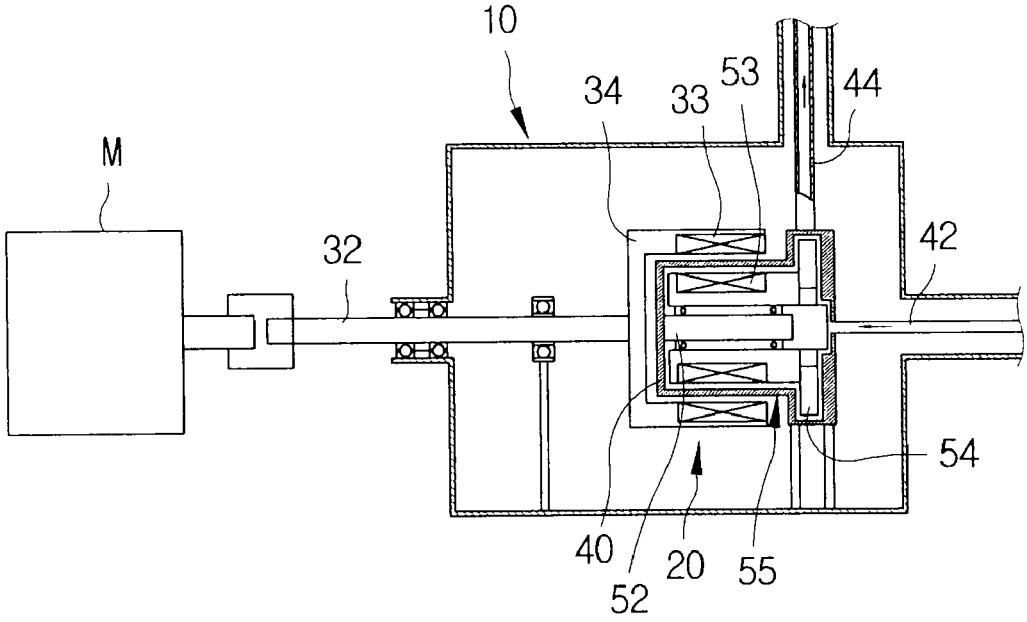
FIG. 2 is a view illustrating the operation of the principal part of the cryogenic fluid circulation pump according to the embodiment of the present invention.

FIG. 1 is a sectional view schematically illustrating a principal part of a cryogenic fluid circulation pump 1 according to an embodiment of the present invention, and FIG. 2 is a view illustrating the operation of the principal part of the cryogenic fluid circulation pump 1 according to the embodiment of the present invention.

As shown in FIGS. 1 and 2, the cryogenic fluid circulation pump 1 circulates a cryogenic fluid, such as general LNG or liquid oxygen, which is maintained at a sub-zero temperature of approximately −183° C. or less, while minimizing the loss of the cryogenic fluid due to evaporation.

In this embodiment, in order to prevent heat from permeating into the cryogenic fluid by convection during the circulation of the cryogenic fluid by the pump 1 and, at the same time, to minimize the transfer of heat to the cryogenic fluid circulating through a rotary shaft of the pump 1, the pump 1 is constructed in a structure in which a magnet pump unit 20 configured to rotate by a magnetic force, not in general shaft-connection type power transmission fashion, for circulating the cryogenic fluid, when a rotary force from a power source M, such as a motor, is transmitted to the magnet pump unit 20, is mounted in a vacuum chamber 10 having an introduction channel 12 and a discharge channel 14 formed such that a fluid introduction port and a fluid discharge port, which will be described below, are located inside the introduction channel 12 and the discharge channel 14, respectively, to prevent heat from permeating into the cryogenic fluid by convection.

The magnet pump unit 20 circulates the cryogenic fluid by a rotary unit 50 configured to rotate in a housing 40 in which a fluid introduction port 42 and a fluid discharge port 44 located in the introduction channel 12 and the discharge channel 14, respectively, are disposed by a magnetic force from a drive unit 30 connected to the power source such that the drive unit 30 can rotate. The housing 40 is supported by a general support member made of fiberglass reinforced plastic (FRP) exhibiting no mobility in the vacuum chamber 10, low heat conductivity, and high strength.

The drive unit 30 includes a drive shaft 32 directly connected to the power source M in a general coupling fashion or in a known shaft joint fashion and a drive member 34 configured to surround the outer circumference of one side of the housing 40 inside the vacuum chamber 10 at the end of the drive shaft 32, the drive member 34 having a plurality of magnets 33 disposed at the inner circumference thereof in contact with the housing 40 at predetermined intervals.

In the above-described structure, a general magnetic fluid seal may be mounted at the connection between the vacuum chamber and the drive shaft for preventing the penetration of foreign matter, such as dust, moisture, or corrosive matter, while maintaining the degree of vacuum in the vacuum chamber with a general bearing. Also, a bearing 35 may be mounted between the connection between the vacuum chamber and the drive shaft and the drive member for minimizing the mobility due to the rotation of the drive shaft and thus achieving stable rotation. The bearing 35 is supported by the support member 31.

The rotary unit 50 may include a rotary member 55 including a magnet 53 disposed at the outer circumference of one side of a general bearing block on a stationary shaft 52 disposed in the housing 40 such that the magnet 53 can freely rotate and an impeller 54 disposed at the side of the bearing block opposite to the side where the magnet is disposed, at a position adjacent to the fluid introduction port and the fluid discharge port.

It is preferable for the housing 40 and the impeller 54 to be made of a material that is not affected by a magnetic force while maintaining thermal contraction or appropriate strength at an ultralow temperature condition, e.g., stainless steel (SUS 304). The housing may be sealed by a mechanical seal to minimize the leakage of the cryogenic fluid even in the vacuum chamber.

In the cryogenic fluid circulation pump with the above-stated construction, as shown in FIG. 2, the cryogenic fluid is circulated through the magnet pump unit 20 mounted in the vacuum chamber 10, such that the magnet pump unit 20 is not exposed to the atmosphere, for rotating by a magnetic force, when a rotary force is transmitted to the magnet pump unit 20. Consequently, the penetration of heat due to convection is prevented by the vacuum chamber.

As the drive shaft 32 of the drive unit connected to the power source is rotated, the rotary member 55 freely rotatably mounted on the stationary shaft 52 in the housing 40 is rotated by the magnets 33 of the drive member 34 connected to the end of the drive shaft. That is, the impeller 54 is rotated by a magnetic force between the magnets 33 and the magnet 53 disposed at the outer circumference corresponding to the magnets 33. As a result, the cryogenic fluid, introduced through the fluid introduction port 42, is discharged through the fluid discharge port 44.

In other words, the drive shaft, connected to the power source, is not directly connected to the impeller to rotate the impeller, but the impeller is rotated by a magnetic force of the magnets mounted at the drive member disposed at the end of the drive shaft and at the rotary member mounted on the stationary shaft disposed in the housing. Consequently, the drive shaft and the stationary shaft are not directly connected to each other, and therefore, it is possible to minimize the transfer of heat through the shafts.

In addition, a sealing unit, such as a mechanical seal or a labyrinth seal, used to prevent the leakage between the housing and the drive shaft in the conventional shaft connection structure is not necessary.

In the pump according to this embodiment, therefore, the penetration of heat by convection during the circulation of the cryogenic fluid is prevented by the vacuum chamber, and, at the same time, the rotation of the impeller is achieved by a magnetic force from the magnets, not by a general shaft connection fashion. Consequently, it is also possible to prevent the transfer of heat through the shafts.

In the above description, the impeller mounted in the housing is formed in the same shape as that applicable to a general fluid pump, and is constructed in a structure in which the fluid introduction port is disposed at the front of the housing and the fluid discharge port is disposed at the side perpendicular to the fluid introduction port, as an example. However, the impeller may be applicable to the structure of a general friction pump, e.g., a Wesco pump. That is, the impeller may be applicable to a general structure in which the impeller is mounted in the housing, and the fluid introduction port and the fluid discharge port are disposed at the side of the housing.

As is apparent from the above description, the cryogenic fluid circulation pump according to the present invention is capable of preventing heat from permeating into a cryogenic fluid by convection during the circulation of the cryogenic fluid by the pump by the provision of the vacuum chamber and, at the same time, achieving the rotation of the pump by a magnetic force, thereby minimizing the transfer of heat to the cryogenic fluid circulating through the shaft during the rotation of the shaft. Consequently, the present invention has the effect of minimizing the evaporation of the cryogenic fluid while preventing the leakage of the cryogenic fluid during the circulation of the cryogenic fluid, thereby achieving smooth circulation and feeding of the cryogenic fluid.

Also, it is not necessary to extend the shaft to prevent the heat transfer, and the impeller is rotated by a magnetic force. Consequently, it is possible to considerably reduce the entire length of the pump.

Although the exemplary embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A cryogenic fluid circulation pump for circulating a cryogenic fluid to feed the cryogenic fluid, the cryogenic fluid circulation pump comprising:

a magnet pump unit mounted in a vacuum chamber having an introduction channel and a discharge channel formed therein to prevent heat from permeating into the cryogenic fluid by convection for rotating by a magnetic force to circulate the cryogenic fluid, when a rotary force from a power source is transmitted to the magnet pump unit, wherein the magnet pump unit circulates the cryogenic fluid by a rotary unit configured to rotate in a housing having a fluid introduction port and a fluid discharge port formed therein by a magnetic force from a drive unit connected to the power source such that the drive unit can rotate, wherein the drive unit comprises a drive shaft directly connected to the power source and a drive member configured to surround an outer circumference of one side of the housing inside the vacuum chamber at one end of the drive shaft, the drive member having a plurality of magnets disposed at an inner circumference thereof in contact with the housing at predetermined intervals, and wherein the rotary unit comprises a rotary member comprising a magnet disposed at an outer circumference of one side thereof on a stationary shaft disposed in the housing such that the magnet can freely rotate and an impeller disposed at the side thereof opposite to the side where the magnet is disposed, at a position adjacent to the fluid introduction port and the fluid discharge port.

* * * * *